US007744305B2

(12) United States Patent
Choi

(10) Patent No.: US 7,744,305 B2
(45) Date of Patent: Jun. 29, 2010

(54) MANHOLE WITH LOCKING DEVICE

(75) Inventor: Ig-Gu Choi, Yeongcheon-si (KR)

(73) Assignee: Saegye Cast Iron Co., Ltd., Gyeongsan-si (KR)

( * ) Notice: Subject to any disclaimer, the term of this patent is extended or adjusted under 35 U.S.C. 154(b) by 45 days.

(21) Appl. No.: 12/089,979

(22) PCT Filed: Jul. 24, 2006

(86) PCT No.: PCT/KR2006/002910

§ 371 (c)(1),
(2), (4) Date: Apr. 11, 2008

(87) PCT Pub. No.: WO2007/043747

PCT Pub. Date: Apr. 19, 2007

(65) Prior Publication Data

US 2008/0196316 A1 Aug. 21, 2008

(30) Foreign Application Priority Data

Oct. 13, 2005 (KR) ..... 10-2005-0096436

(51) Int. Cl.
*E02D 29/14* (2006.01)

(52) U.S. Cl. ..... 404/25

(58) Field of Classification Search ..... 404/25, 404/26; 52/19, 20; 137/371
See application file for complete search history.

(56) References Cited

U.S. PATENT DOCUMENTS 911,256 A * 2/1909 McWane ..... 220/251

(Continued)

*Primary Examiner*—Gary S Hartmann
(74) *Attorney, Agent, or Firm*—Joseph H. Kim; JHK Law

(57) ABSTRACT

The present invention relates to a manhole (10) with a locking device, and more particular to a manhole with a locking device, which comprises a manhole frame (20) having a plurality of insertion slots (24) inwardly protruded from an inner circumferential surface thereof, each insertion slot (24) having a latching protrusion (26) formed in such a manner that a top surface of the insertion slots (24) is partially opened; a bearing member (30) having a female screw portion formed on the center thereof and a plurality of fastening pieces (36) radially formed outwardly from the outer circumferential edge thereof, so that the bearing member (30) is detachably fastened to the manhole frame (20); and a manhole cover (40) having a through-hole (41) centrally formed therein so that an upper portion of the vertical screw rod (42) is rotatably inserted into the through-hole (41), the vertical screw rod (42) having a male screw portion (45) formed on the lower portion thereof so as to be threadably fastened to the female screw portion (35) of the bearing member, a head portion (43) formed on the upper portion thereof so as to abut against an upside surface of the manhole cover (40), and a support portion (44) formed on the upper portion thereof so as to abut against an underside of the manhole cover (40), so that the manhole cover (40) is closed by rotating the head portion (40) of the vertical screw rod (42). Thus, in a case of the manhole (10) mounted on a vehicle road, the manhole cover (40) is prevented from being separated from the manhole frame (20) without permission by a vehicle running at a high speed as well as from frictional noise generated between the manhole cover (40) and the manhole frame (20). Further, in a case of the manhole (10) mounted on the waterside of a river, the manhole (10) maintains its watertightness and is readily opened and closed by an operator.

2 Claims, 4 Drawing Sheets

U.S. PATENT DOCUMENTS 1,001,041 A * 8/1911 Jones ..... 49/33
1,204,464 A * 11/1916 Lofton ..... 137/371
2,363,567 A * 11/1944 Blakeman ..... 292/6
2,488,796 A * 11/1949 Baier ..... 114/201 R
4,577,478 A * 3/1986 Economopoulos et al. .... 70/168
4,964,755 A * 10/1990 Lewis et al. ..... 404/25
5,071,177 A * 12/1991 Spiess et al. ..... 292/91
5,697,729 A * 12/1997 Bowman ..... 404/25
6,435,763 B1 * 8/2002 Sakane et al. ..... 404/25
6,550,294 B2 * 4/2003 Garguilo ..... 70/168
7,261,332 B1 * 8/2007 Petersen et al. ..... 292/121

* cited by examiner

[Fig. 1]
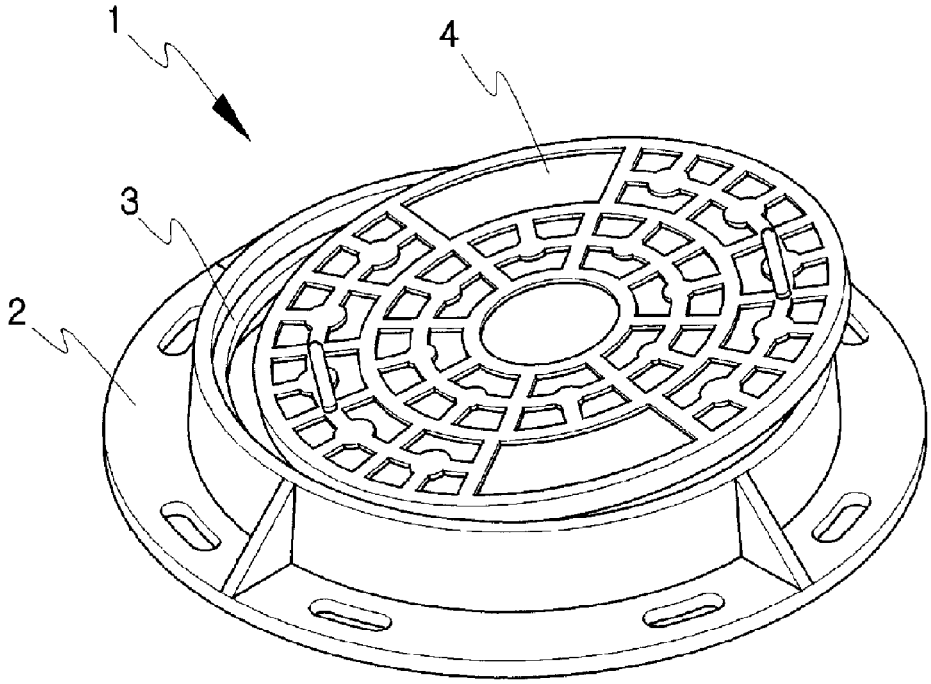
[Fig. 2]
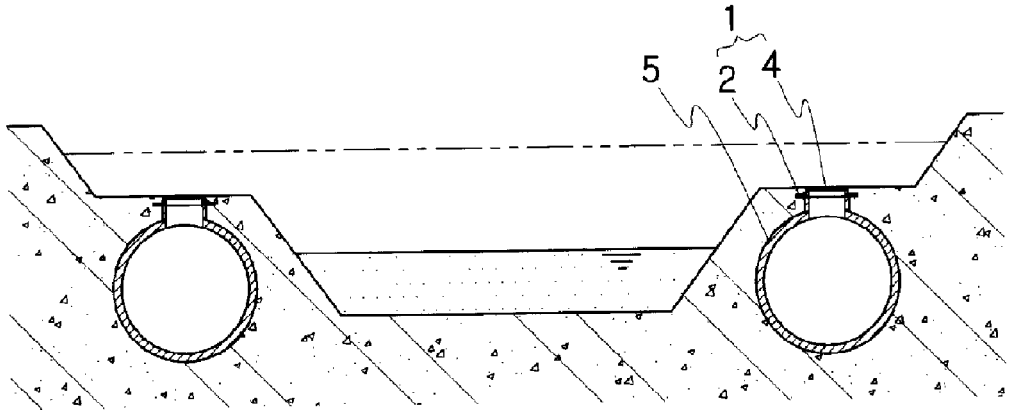

[Fig. 3]
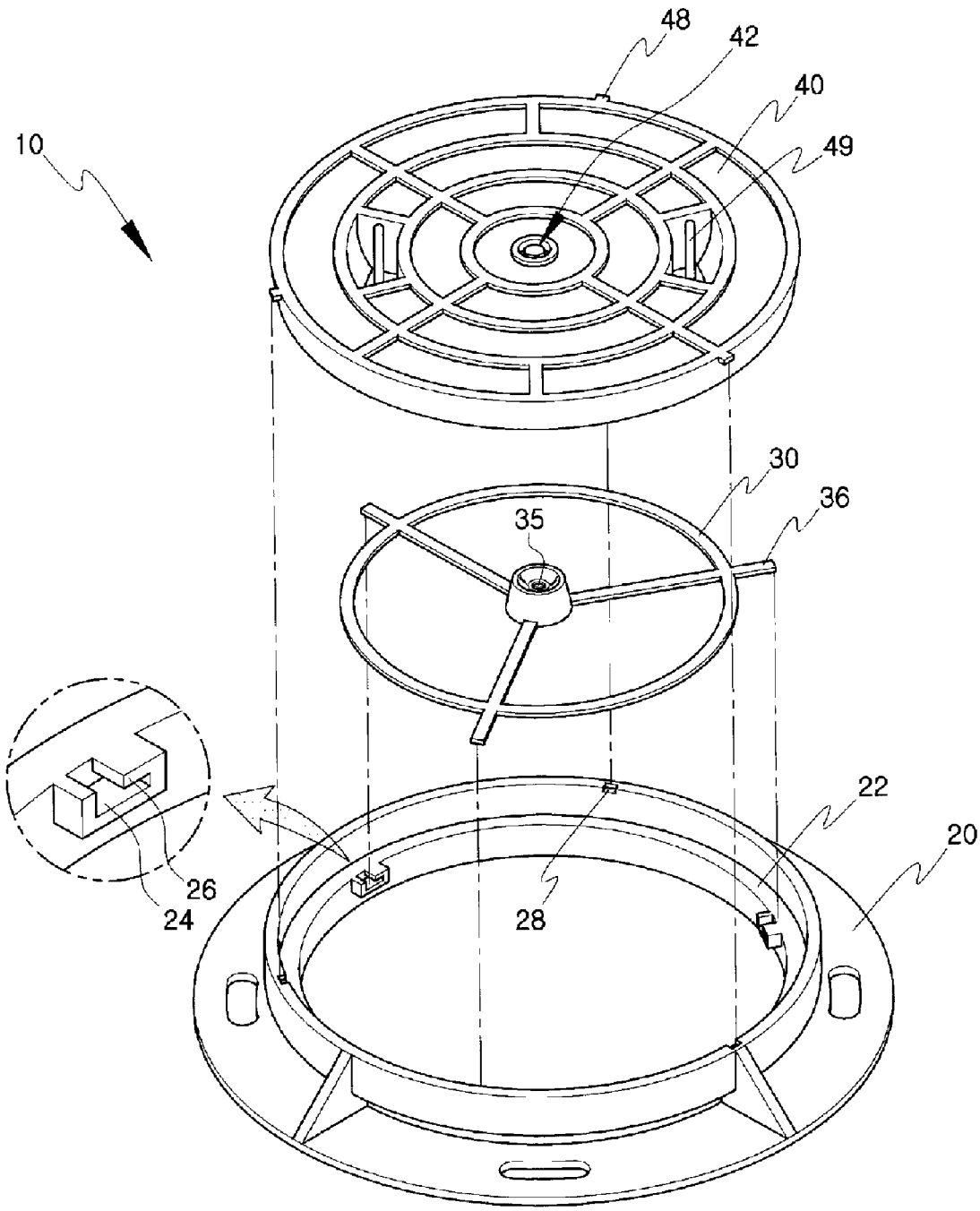

[Fig. 4]
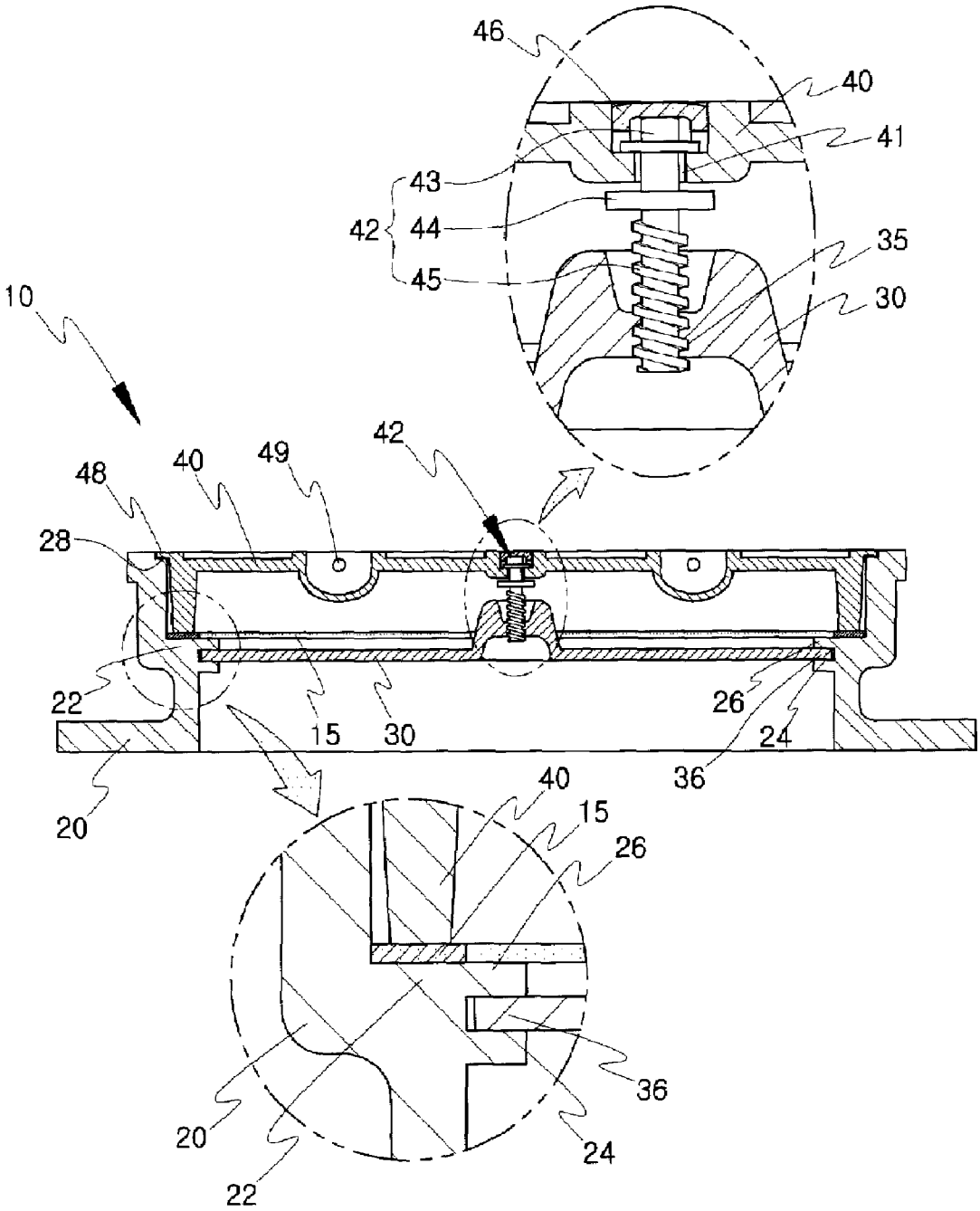

[Fig. 5]
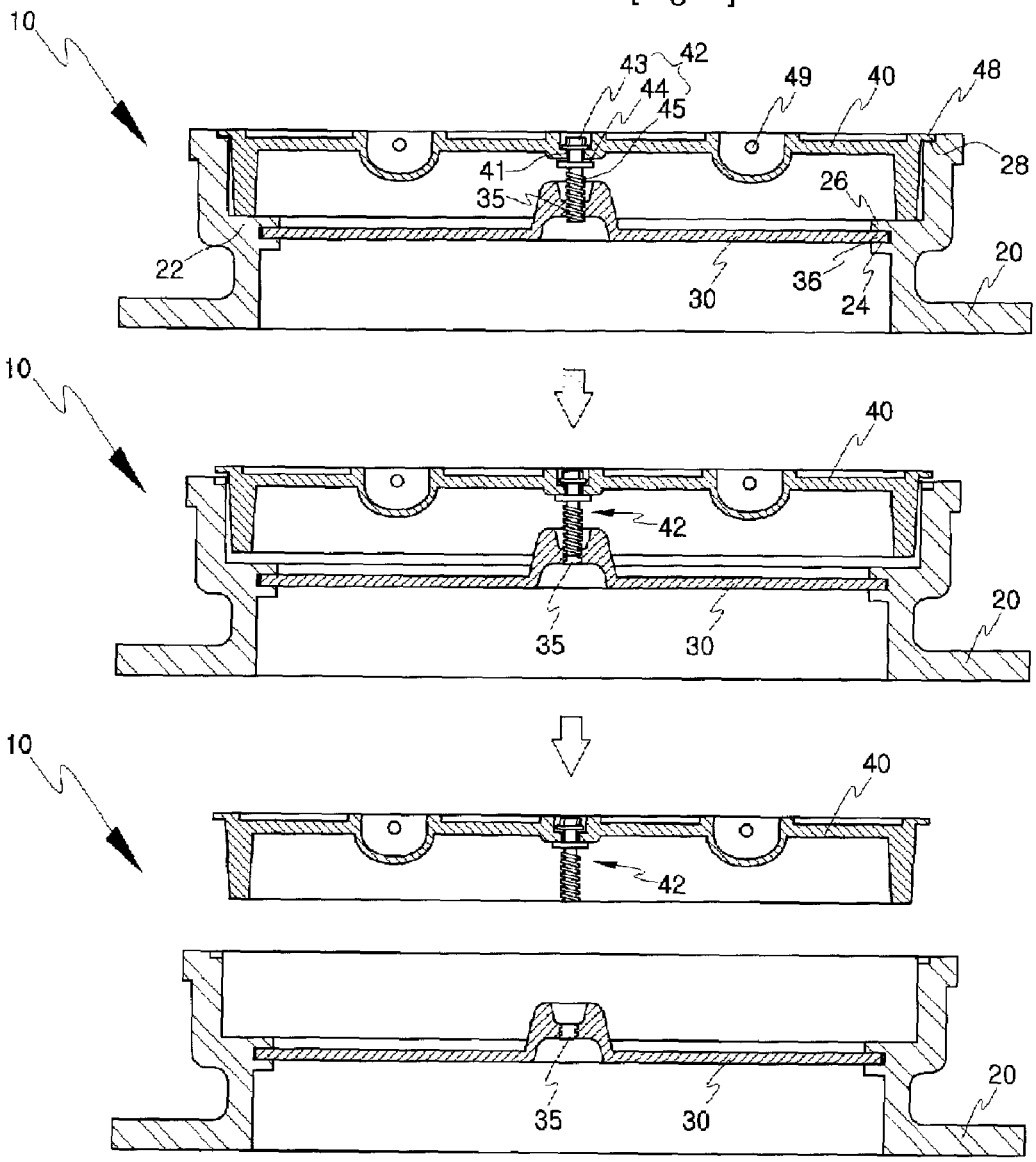

MANHOLE WITH LOCKING DEVICE

TECHNICAL FIELD

The present invention relates to a manhole with a locking device, and more particular to a manhole with a locking device, which comprises a bearing member having a female screw portion centrally formed therein and adapted to be detachably fastened to a fixing means formed on an inner circumferential surface of a manhole frame; a manhole cover having a through-hole centrally formed therein so that a vertical screw rod is rotatably inserted into the through-hole, the vertical screw rod having a male screw portion formed on a lower portion thereof so as to be threadably fastened to the female screw portion of the bearing member, and a head and a support portions formed on an upper portion thereof so as to support an upside surface and an underside surface of the manhole cover, respectively; and a means for preventing rotation of the manhole cover formed on the manhole cover, whereby the manhole cover is opened or closed from the manhole frame by fastening or loosening the vertical screw rod.

BACKGROUND ART

Generally, a manhole is mounted in openings of a drainage pipe for drainage of sanitary sewage or storm sewage, or openings of underground facilities installed for buryng electric power lines or communication lines. Referring to FIG. 1, the conventional manhole 1 comprises a manhole frame 2 located in openings to access to the sewer or the underground facilities to be buried and installed in the ground surface and a manhole cover 4 rested on a retaining step 3 formed on an inner circumferential surface of the manhole frame 2 for opening or closing the manhole 1.

Meanwhile, in case of the manhole 1 described above, since the manhole cover 4 is merely rested on the manhole frame 2, there occurs a problem in that the manhole cover 4 is separated from the manhole frame 2 without any previous warning. For example, as shown in FIG. 1, in case of the manhole 1 installed on a vehicle road, the manhole cover 4 is separated from the manhole frame 2 by a vehicle running at a high speed, and hence, there occur problems such as deviation of the vehicle from the vehicle road or an accident of collision with the following vehicles.

In addition, as shown in FIG. 2, in case where the manhole 1 is mounted on an opening of a sanitary sewer pipe 5 buried in the waterside of a river, if the manhole 1 is submerged in the water due to the flood of a river in rainy weather, the manhole cover 4 is opened by a flow speed of the river or rainy water is flowed into the sanitary sewer pipe 5 through a gap between the manhole frame 2 and the manhole cover 4, both of which results in an increase in volume of the sewage flowed into a sewage treatment plant, to thereby create an unnecessary cost for sewage treatment.

In order to solve the above problems, a variety of fastening means for preventing separation of the manhole cover from the manhole frame and manholes for maintaining watertightness have been devised. However, the fastening means or manholes are so far impossible to be put to practical use due to their structure unsuitable for casting process in spite of most manholes made of cast-ironed material, or due to inconvenience in use and troublesome problems in that the manhole cover is, once locked, hardly opened and the like as well as the complicated configuration.

DISCLOSURE OF INVENTION

Technical Problem

Accordingly, the present invention has been made to solve the above problems occurring in the prior art, and it is an object of the present invention to provide a manhole with a locking device, which prevents separation of a manhole cover from a manhole frame occurring due to an external force of vehicles and the like and is capable of maintaining watertightness, the manhole comprising a bearing member having a female screw portion centrally formed therein and adapted to be detachably fastened to a fixing means formed on an inner circumferential surface of a manhole frame; a manhole cover having a through-hole centrally formed therein so that a vertical screw rod, which has a male screw portion formed on a lower portion thereof so as to be threadably fastened to the female screw portion of the bearing member, is rotatably inserted into the through-hole, the vertical screw rod being formed so as to support the manhole cover; and a means for preventing rotation of the manhole cover formed on the manhole cover, whereby the manhole cover is opened or closed from the manhole frame by fastening or loosening the vertical screw rod.

Technical Solution

In order to accomplish the above objects, according to the present invention, there is provided a manhole with a locking device, which comprises a bearing member having a female screw portion centrally formed therein and adapted to be detachably fastened to a fixing means formed on an inner circumferential surface of a manhole frame; a manhole cover having a through-hole formed therein so that a vertical screw rod is rotatably inserted into the through-hole, the vertical screw rod having a male screw portion formed on a lower portion thereof so as to be threadably fastened to the female screw portion of the bearing member and a head and a support portions formed on the upper portion thereof so as to support an upside and an underside surfaces of the manhole cover, respectively; and a means for preventing rotation of the manhole cover formed on the manhole cover.

Advantageous Effects

As described above, according to the manhole with a locking device, it is possible to prevent separation of the manhole cover from the manhole frame as well as frictional noise generated between the manhole cover and the manhole frame, and to allow an operator to readily open and close the manhole cover. In case where the manhole with a locking device is mounted in the waterside of a river, it has an effect capable of maintaining its watertightness.

BRIEF DESCRIPTION OF THE DRAWINGS

Further objects and advantages of the invention can be more fully understood from the following detailed description taken in conjunction with the accompanying drawings, in which:

FIG. 1 is a perspective view of a typical manhole;

FIG. 2 is a cross-sectional view of a conventional manhole mounted on an opening of a sewage, which is buried and installed in the waterside of a river;

FIG. 3 is an exploded perspective view of a manhole with a locking device according to the present invention;

FIG. 4 is a cross-sectional view of a manhole with a locking device according to the present invention; and FIG. 5 is a view showing a process where a manhole cover of the manhole with a locking device according to present invention is separated from a manhole frame.

MODE FOR THE INVENTION

A configuration of a manhole with a locking device (hereinafter, refers to as "manhole" according to an embodiment of the present invention will be hereafter described in detail with reference to FIGS. 3 through 4.

According to the configuration of a manhole 10 according to the present invention, a manhole frame 20 has an annular retaining step 22 inwardly protruded from an inner circumferential surface thereof and has a fixing means protruded inwardly from the inner circumference of the annular retaining step 22, so that a bearing member 30 is detachably fastened to the manhole frame 20 through the fixing means. The fixing means includes a plurality of insertion slots 24 each having a latching protrusion 26, which is formed in such a manner that a part of a top surface of the insertion slot 24 is opened.

Further, the bearing member 30 has a female screw portion 35, preferably, formed on the center thereof and a plurality of fastening pieces 36 radially formed outwardly from the outer circumferential edge thereof so as to be inserted into and fastened to the fixing means. Here, each fastening piece 36 is inserted through a partially-opened top surface of each of the insertion slots 24 and rotated so as to be caught by the latching protrusion 26, so that the bearing member 30 can be fastened to the manhole frame 20.

According to the configuration of a manhole cover 40 rested on the annular retaining step 22 of the manhole frame 20, a vertical screw rod 42, which has a male screw portion 45 formed on the lower portion thereof so as to be inserted into and fastened to the female screw portion 35 of the bearing member 30, is rotatably inserted into a through-hole 41 centrally formed in the manhole cover 40. At this time, the upper portion of the screw 42 passes through the through-hole 41. The vertical screw rod 42 has a head portion 43 formed on the upper portion thereof so as to abut against an upside surface of the manhole cover 40, and a support portion 44 formed on the upper portion thereof so as to abut against an underside surface of the manhole cover 40.

Meanwhile, the head portion 43 of the vertical screw rod 42 is a typical polyhedral-bolt head, and may be rotated using a typical wrench and the like. The support portion 44 may be formed of a pin passing through the vertical screw rod 42, or formed such that an annular plate is welded to the outer peripheral surface of the vertical screw rod 42.

Further, the manhole cover 40 is preferably further provided with a means for preventing its rotation, although the manhole cover 40 is hardly rotated along with the vertical screw rod 42 due to a frictional force with the manhole frame 20 or the weight itself of the manhole cover 40 when rotating the vertical screw rod 42. Here, the means for preventing rotation of the manhole cover 40 includes a plurality of indentations 28 formed on an upper end of the inner circumferential surface of the manhole frame 20 and a plurality of protrusions 48 outwardly protruded from the outer circumferential surface of the manhole cover 40 so as to correspond to the plurality of indentations 28, so that the manhole cover 40 is prevented from its rotation.

Further, in case of the manhole mounted in the waterside of a river and the like, an annular packing member 15 is interposed between the manhole frame 20 and the manhole cover 40, to thereby maintain watertightness of the manhole 10. In this case, the packing member 15, as shown in FIG. 4, may be rested on the annular retaining step 22 of the manhole frame 20, may be inserted into an annular insertion recess (not shown) formed on the annular retaining step 22, or may be inserted around a lower end of the manhole cover 20 (not shown).

Meanwhile, an upper portion of the bearing member 30 having the female screw portion 35, to which the vertical screw rod 42 is threadably fastened, is preferably formed in a shape which is gradually narrowed toward its lower end, so that it can allow the vertical screw rod 42 to be more readily fastened to the female screw portion 35. Reference numeral "46" which has been not described denotes a rubber stopper 46 for preventing corrosion of the vertical screw rod 42 and interruption of operating of the vertical screw rod 42 due to an inflow of foreign substance to the head portion 43 of the vertical screw rod 42, and reference numeral "49" denotes a grip of the manhole cover 40.

An operation of the manhole 10 according to the present invention configured described above will be hereafter described in detail with reference to FIGS. 3 through 5.

First, in case where the manhole cover 40 is rested on the manhole frame 20, each of the fastening pieces 36 of the bearing member 30 is inserted through the partially-opened top surface of each of the insertion slots 24 formed on the manhole frame 20 and rotated so as to be caught by the latching protrusion 26, so that the bearing member 30 is fastened to the manhole frame 20. Thereafter, the male screw portion 45 of the vertical screw rod 42 is positioned on the female screw portion 35 of the bearing member 30, and the head portion 43 of the vertical screw rod 42 is rotated by using a typical wrench and the like, so that the manhole cover 40 supported by the support portion 44 of the vertical screw rod 42 is lowered while the vertical screw rod 42 is inserted and fastened to the female screw portion 35 of the bearing member 30. At this time, the plurality of protrusions 48 of the manhole cover 40 is inserted in the plurality of indentations 28 of the manhole frame 20.

When the vertical screw rod 42 is rotated so as to allow the manhole cover 40 to be completely rested on the manhole frame 20 in the way as described above, the head portion 43 of the vertical screw rod 42 pressurizes the upside surface of the manhole cover 40, to thereby prevent separation of the manhole cover from the manhole frame 20 due to an external force of vehicles and the like without any previous waring, as well as frictional noise generated between the manhole cover 40 and the manhole frame 20. In addition, in the case where the annular packing member 15 is interposed between the manhole frame 20 and the manhole cover 40, it is possible to maintain watertightness of the manhole 10.

Further, when the manhole cover 40 is opened, the head portion 43 of the vertical screw rod 42 is rotated in the opposite direction to the initial direction of fastening of the vertical screw rod 42, the vertical screw rod 42 is separated from the bearing member 30 to be raised, and hence the support portion 44 of the vertical screw rod 42 pushes up the underside surface of the manhole cover 40, to thereby open the manhole cover 40. At this time, the plurality of protrusions 48 of the manhole cover 40 are inserted into the indentations 28 of the manhole frame 20, to thereby prevent the manhole cover 40 from being rotated along with the vertical screw rod 42.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A manhole with a locking device comprising: a manhole frame including an annular retaining step formed on an inner circumferential surface thereof, the annular retaining step having a plurality of insertion slots protruded inwardly from an inner circumference of the retaining step and a latching protrusion formed in such a manner that a top surface of the insertion slots is partially opened, and a plurality of indentations formed on an upper end of the inner circumferential surface of the manhole frame; a bearing member including a female screw portion centrally formed therein and a plurality of fastening pieces radially formed outwardly from the outer circumferential edge thereof so as to be detachably fastened to the plurality of insertion slots; a manhole cover rested on the retaining step of the manhole frame and including a plurality of protrusions outwardly protruded from the outer circumferential surface of the manhole cover so as to correspond to the plurality of indentations; and a packing member interposed between the manhole frame and the manhole cover, wherein the manhole cover has a through-hole centrally formed therein, so that an upper portion of a vertical screw rod is rotatably inserted into the through-hole, the vertical screw rod having a male screw portion formed on the lower portion thereof so as to be threadably fastened to the female screw portion of the bearing member, a head portion formed on the upper portion thereof so as to abut against an upside surface of the manhole cover, and a support portion formed on the upper portion so as to abut against an underside surface of the manhole cover, whereby the head portion of the vertical screw rod is rotatable so that the manhole cover is lowerable to be closed to thereby maintain watertightness, or is raisable to be opened.

2. The manhole with a locking device according to claim 1, wherein an upper portion of the bearing member having the female screw portion is formed in a shape which is gradually narrowed toward its lower end.

* * * * *